United States Patent [19]

Lathim et al.

[11] Patent Number: 4,943,066

[45] Date of Patent: Jul. 24, 1990

[54] BALL-LIKE ARTICLE

[75] Inventors: Delbert L. Lathim, Pasco, Wash.; Ting Liu; Charles F. Foley, both of Charlotte, N.C.

[73] Assignee: Research & Development of North Carolina, Charlotte, N.C.

[21] Appl. No.: 305,518

[22] Filed: Feb. 2, 1989

[51] Int. Cl.[5] ..... A63B 43/02

[52] U.S. Cl. ..... 273/415; 273/58 A; 273/428; 272/67

[58] Field of Search ..... 273/415, 428, 58 F; 272/67

[56] References Cited

U.S. PATENT DOCUMENTS 4,088,319 5/1978 Clarke ..... 273/58 F X 4,151,994 5/1979 Stalberger, Jr. ..... 273/415 X 4,294,447 10/1981 Clark ..... 273/428 X 4,354,679 10/1982 Steinmetz ..... 273/415 X

*Primary Examiner*—Paul E. Shapiro

*Attorney, Agent, or Firm*—Shefte, Pinckney & Sawyer

[57] ABSTRACT

A ball-like article includes a flexible outer skin of a size and shape adapted to be readily grasped within the palm of one hand. The skin has a plush outer surface and defines an interior approximately fifty percent (50%) of which is occupied by a quantity of plastic pellets or other granular material to be movable in a generally fluidic fashion within the interior. The article has a characteristic kneadable quality adapted for therapeutic manual manipulation, light manual tossing and catching, and other non-impactive recreational activities.

23 Claims, 2 Drawing Sheets

BALL-LIKE ARTICLE

BACKGROUND OF THE INVENTION

The present invention relates to a ball-like article suitable for a variety of recreational activities.

Various game bags and balls are known which basically include a pliable cover within which a quantity of pellets, disks, granules, or another filler material is contained for use in playing a variety of games. Representative examples of such articles are disclosed in U.S. Pat. Nos. 3,091,460; 3,734,498; 3,924,856; 3,937,470; 4,151,994; and 4,354,679.

Most such articles are designed for games or play wherein the article is repetitively subjected to impactive forces or used in an impactive manner. For example, the articles of U.S. Pat. Nos. 3,091,460; 3,937,470; 4,151,994; and 4,354,679, are preferably embodied as so-called footbags adapted to be repeatedly kicked by the feet or knees of one or more participants as part of a game having the object of keeping the footbag airborne without falling to the ground or floor. Similarly, U.S. Pat. No. 3,734,498 discloses a ball designed to be rollable on hard surfaces for indoor play of the game of Bocce wherein participants' balls are often rolled into striking contact with one another. Likewise, U.S. Pat. No. 3,924,856, discloses a bean bag type ball adapted to be thrown against a set of pins in playing the game of lawn bowling.

SUMMARY OF THE INVENTION

In contrast, it is an object of the present invention to provide a ball-like article adapted for non-impactive recreational activities such as, for example, therapeutic manual manipulation, light manual tossing and catching, and the like, and for this purpose the ball-like article of the present invention is designed to have a kneadable character and quality entirely unlike that of the prior art articles described above.

Briefly summarized, the ball-like article of the present invention includes a flexible permeable outer skin which presents a relatively soft and smooth peripheral surface having a plush feel. The outer skin defines a substantially enclosed interior volume, the skin being of a size and shape adapted to be readily grasped within the palm of one hand. A quantity of a granular material occupies only a portion of the interior volume with the remainder thereof occupied by air for generally fluidic movability of the material within the interior volume in response to centrifugal, inertial, gravitational, manual and other externally imposed forces to enable the article to assume varied configurations.

In the preferred embodiment, the granular material occupies between about 35% and 60%, but preferably about 50% or less, of the interior volume of the outer skin. The outer skin is fabricated of a two-ply sheet material having a fabric substrate and a resilient polymeric plastic layer bonded thereto to provide the desired soft, smooth and plush surface character. The granular material preferably is a pelletized plastic material which is relatively non-resilient and has a relatively low density and relatively low coefficient of friction polypropylene, polyethylene or polystyrene pellets are suitable for this purpose. The pellets should have a generally rounded exterior shape. The largest cross-sectional dimension of the outer skin is in the range of approximately 3 to 6 inches, but otherwise the outer skin may be of any desired shape, e.g. spheroidal or ellipsoidal. The total weight of the article is preferably in the range of approximately four to five ounces.

A tail portion may be attached to the outer skin, which may be grasped to facilitate tossing of the article. In embodiments wherein the outer skin is ellipsoidal in shape, the tail portion is attached to one end of the outer skin. Preferably, the tail portion includes a pair of tail segments each formed of a non-stretchable material attached at a common location to the outer skin and extending outwardly therefrom approximately twenty to twenty-four inches.

DESCRIPTION OF THE PREFERRED EMBODIMENT

Figure 1:
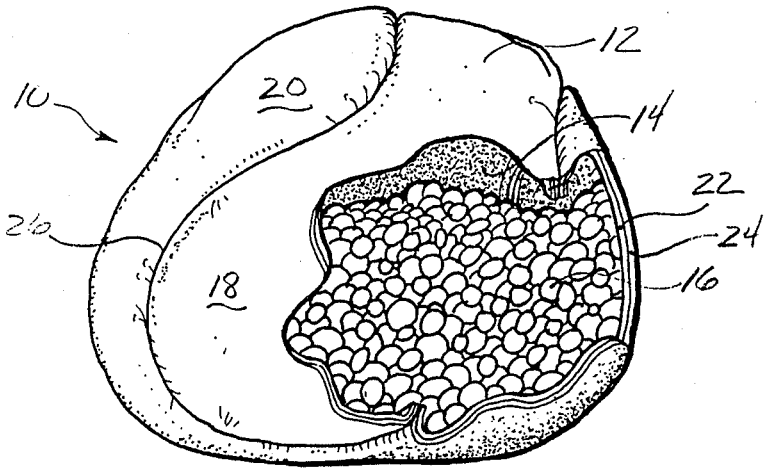
FIG. 1 is a perspective view of a ball-like article according to the preferred embodiment of the present invention, with the outer skin thereof broken away partially to illustrate the granular material contained within its interior.
Figure 2:
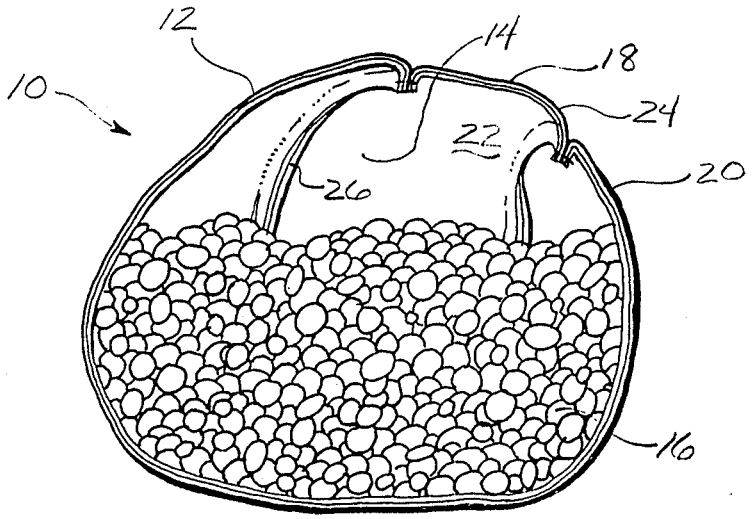
FIG. 2 is a cross-sectional view of the article of FIG. 1 taken diametrically therethrough.

Referring now to the accompanying drawings and initially to FIGS. 1 and 2, a ball-like article according to one embodiment of the present invention is indicated generally at 10 and basically includes an outer skin 12 defining a substantially enclosed interior volume 14 within which a predetermined quantity of a granular filler material 16 is contained.

The outer skin 12 is fabricated of two skin portions 18, 20 of a flexible sheet-like material formed in an identical hour glass shape and stitched together along their respective edges in a continuous seam 26 in a baseball-like fashion but with their juxtaposed edges extending inwardly into the interior volume defined by the outer skin 12. The hand or feel of the ball-like article 10 to touch is an important feature of the present invention and, accordingly, the skin portions 18, 20 should be formed of a highly flexible, pliant material one surface of which is of a very soft and smooth character to be plush or velvety to the touch so as to be suitable as the outer exterior surface of the skin 12 while the opposite surface presents a relatively low frictional resistance to the granular material 16 to allow easy movement of the granular material along such surface yet will resist abrasion as a result thereof so as to be suitable as the interiorly facing surface of the skin 12. A two-ply sheet material having a knitted fabric substrate 22 and a resilient polymeric plastic layer 24 bonded thereto has been found to be optimally suitable for this purpose. For example, various imitation leather products of this type are commercially available, such as the polyvinyl chloride sponge leather material manufactured by Hsin-Li Chemical Industrial Corporation of Taipei, Taiwan, R.O.C. Other suitable imitation leather materials are available which are fabricated of fabric-backed polyurethane. Of course, those persons skilled in the art will recognize that other materials now known or hereafter developed may be equally well suited to provide the desired characteristics herein described.

In accordance with the present invention, the ball-like article 10 should be of an overall size and shape which can be readily grasped within the palm of one hand. Accordingly, the skin portions 18, 20 should be suitably sized to provide the article 10 with an overall cross-sectional diameter broadly within the range of 3 to 6 inches. Since the configuration of the skin 12 of the article 10 is generally simulative in appearance of a baseball, it is preferable that the article 10 have a maximum cross-sectional diameter at the lower extent of such range, e.g., between 3 and 3 ½ inches.

In the procedure of sewing the skin portions 18, 20 together as described, the major extent of the continuous seam 26 is initially formed to leave a small extent opening into the interior volume defined by the skin 12 through which the granular filler material 16 may be inserted into the interior 14 before completion of the seam 26. According to the present invention, the granular filler material 16 is particularly adapted to move within the interior volume 14 in a generally fluidic fashion in conjunction with the skin 12 to contribute to the overall hand and feel of the article. For this purpose, the granular material 16 should occupy only a portion of the interior volume 14, normally within the range of 35% to 60% of the total interior volume but preferably about 50% or somewhat less, with the remainder of the interior 14 being occupied by air. The stitching along the seam 26 between the skin portions 18, 20 provides the skin 12 with a sufficient degree of permeability of the skin 12 so that ambient air can readily pass through the skin 12 into and from the interior 14. The individual granules of the filler material 16 should be of a relatively small size in relation to the total interior volume 14 of the article 10, should be of a shape and surface character to have a relatively low coefficient of friction between the individual granules as well as between the granules and the interior substrate 22 of the skin portions 18, 20, and also should be generally non-flexible and non-resilient so as to avoid any significant degree of compressibility or sponginess. Further, the filler material 16 should be of a density such that the overall total weight of the ball-like article with the outer skin 12 containing a desirable quantity of the filler material is comfortable to handle and toss, preferably in the range of four (4) to five (5) ounces, approximately. For example, the total weight of the article 10 is preferably at the lower extent of such range, i.e. about four ounces. A plastic material such as polypropylene, polyethylene, or polystyrene, formed in relatively small pellets of a generally rounded exterior shape and configuration have been found to be suitable for these purposes. Preferably, the pellets should be of an overall shape as close to spherical as possible in the range of approximately ⅛th of an inch in diameter, as shown in FIGS. 1 and 2, but generally cylindrical pellets of a diameter ranging between 1/16th and ⅛th of an inch and a length ranging between ⅛th and 3/16th of an inch are also suitable (see FIG. 3). Of course, those persons skilled in the art will readily recognize that other granular materials now known or hereafter developed may be equally well suited for use as the granular material 16.

The above-described characteristics of the skin 12 and the granular material 16 combine to provide the article 10 with a highly unique hand and feel which is remarkably different from articles of the prior art. The volumetric range of the interior 14 occupied by the granular material 14 together with the described physical characteristics of the granular material 16 enable the individual granules or pellets to readily move within the interior 14 both with respect to one another and with respect to the surface of the substrate 22 so as to act generally in the nature and manner of a fluid. Thus, when the article 10 is lightly tossed and caught by one or more users, the granular material 16 moves within the interior 14 in response to the centrifugal, inertial, gravitational and manual forces exposed externally on the article 10. As a result, the article 10 is very easy to toss and catch since the interior air volume of the article provides a natural cushion between the article 10 and any surface with which it contacts. Thus, unlike conventional balls, the article 10 has essentially no tendency to sting the hand when caught. Also, the article tends to settle without any rebound or bouncing effect on any surface onto which the article lands. As such, the article 10 provides an ideal toy ball for use by young children to train their hand-to-eye coordination with minimal, if any, risk of injury to the child or damage to walls, furniture and other items with which the article may come into contact. The article 10 additionally can be caused to roll along floors or walls by spinning it with sufficient speed to centrifugally sling the granular material within the article interior creating inertia to continue spinning rotation. Further, the plush surface character of the outer skin 12 in conjunction with the fluidic character of the granular material 16 provides the ball with a kneadable quality when merely held within the palm of one's hand and manipulated with the fingers, which not only is unusually pleasing to the touch but also has been found to provide a highly therapeutic release for nervous energy and otherwise to promote overall body relaxation.

Figure 3:
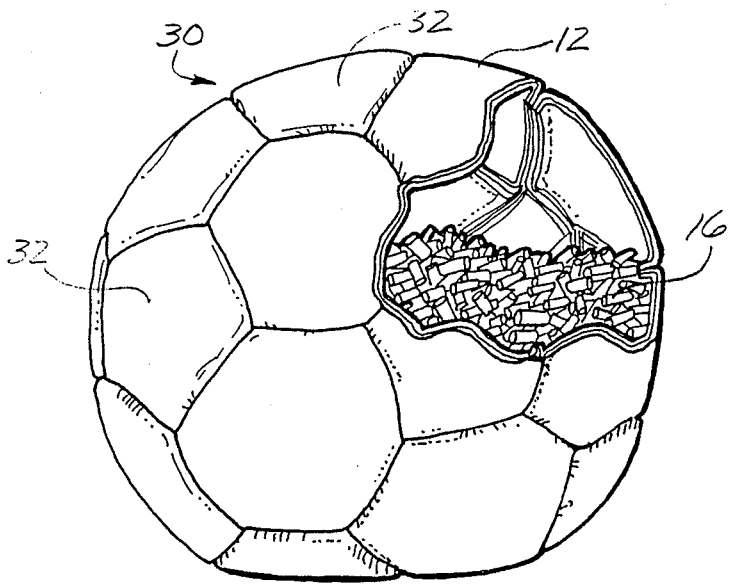
FIG. 3 is a perspective view of another embodiment of ball-like article according to the present invention.
Figure 4:
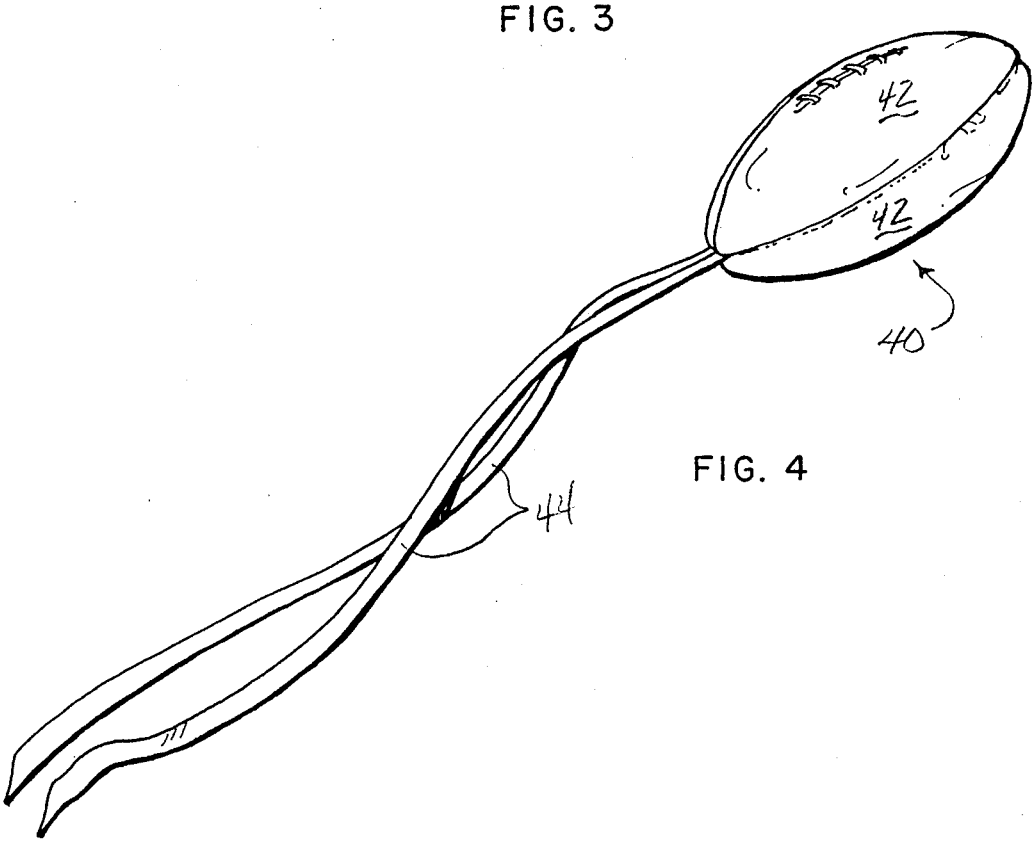
FIG. 4 is a perspective view of a further embodiment of a ball-like article according to the present invention.

As will be readily understood, ball-like articles according to the present invention may be formed of other skin configurations and sizes from the article 10 of FIGS. 1 and 2. By way of example and without limitation, two other possible embodiments of ball-like articles within the scope and substance of the present invention are shown in FIGS. 3 and 4. In FIG. 3, a ball-like article is generally indicated at 30, the outer skin 12 of which is fabricated of a plurality of polygonal skin sections 32 sewn together along juxtaposed edges generally in the fashion of a conventional soccer ball. As such, the article 30 has a generally spheroidal overall shape similar to that of the article 10 but, in contrast thereto, the article 30 is preferably of an overall maximum cross-sectional diameter in the range of approximately 4 to 5 inches and a total weight of approximately five ounces so as to be relatively larger and heavier than the article 10. Otherwise, the characteristics of the skin and granular filler material of the article 30 are identical to that of the article 10 so that the article 30 has substantially the same qualities and uses as the article 10.

The ball-like article of FIG. 4, indicated generally at 40, has an outer skin 12 fabricated of a plurality of identical skin sections 42 generally having the shape of an ellipse and sewn together along juxtaposed edges in the fashion of a football or rugby ball so that the article 40 is of a generally ellipsoidal shape. Preferably, the article 40 is of an overall length in the range of 5 to 6 inches and is of a maximum cross-sectional dimension at a location generally centrally along its length in the range of 3 to 4 inches. The preferred total weight of the article 40 is about four and one-half (4.5) ounces. Otherwise, the characteristics of the skin and filler material of the article 40 are substantially within the same parameters as described above for the article 10 of FIGS. 1 and 2.

According to another feature of the present invention, the present ball-like article may be provided with a tail portion attached to and extending outwardly from the main body of the article to facilitate tossing of the article. For example, the article 40 of FIG. 4 is shown to be additionally provided with a tail portion formed by a pair of tail segments 44 sewn to and extending from a common location at one lengthwise end of the ellipsoidal outer skin of the article 40. The tail segments 44 preferably are formed of a highly flexible yet strong and non-stretchable material suitable to resist damage or deterioration from any centrifugal forces which may be produced by tossing the article 40 by the tail segments. The tail segments 44 should be of a sufficient length to provide a reasonable degree of leverage of tossing the article with a minimal effort yet not excessively long to be cumbersome. A length of twenty (20) to twenty-four (24) inches and a width of approximately three-quarters (0.75) of an inch for each tail segment 44 is believed to be optimal. The tail segments 44 thus provide a means by which the article 40 may be grasped and tossed with a minimal amount of effort essentially as an extension of the user's arm, the tail portion also serving to guide the article 40 to assume a spiraling-type pattern of flight in the nature of a football which is essentially not possible if the body of the article 40 itself were to be grasped and tossed in view of the relatively low proportion of the article interior occupied by the filler material.

As will be understood, the tail portion enables the article 40 to be tossed relatively greater distances than the articles 10, 30 and is therefore susceptible of a wider range of possible recreational uses. Accordingly, it is contemplated that the outer skin of the article 40 or of other ball-like articles having a tail portion, may be fabricated of a stronger, more durable and less stretchable material than that of the articles 10, 30 to facilitate other recreational activities such as long distance throwing and catching. For example, a two-ply imitation leather sheet material like that utilized for the outer skin of the articles 10, 30, but with a woven rather than knitted fabric substrate, is preferred for this purpose.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A ball-like article comprising a flexible permeable outer skin presenting a relatively soft and smooth peripheral surface which has a plush feel and defining a substantially enclosed interior volume, said skin being of a size and shaped adapted to be readily grasped within the palm of one hand, a quantity of a granular material occupying only a portion of said interior volume with the remainder thereof occupied by air for generally fluidic movability within said interior volume in response to centrifugal, inertial, gravitational, manual and other externally imposed forces to enable said article to assume varied configurations, said article being characterized by a kneadable quality to be adapted for therapeutic manual manipulation, light manual tossing and catching, and other non-impactive recreational activities, and a tail portion attached to said outer skin for grasping and tossing said article.

2. A ball-like article according to claim 1 and characterized further in that said granular material occupies less than about sixty percent (60%) of said interior volume.

3. A ball-like article according to claim 2 and characterized further in that said granular material occupies less than about fifty percent (50%) of said interior volume.

4. A ball-like article according to claim 3 and characterized further in that said granular material occupies more than about thirty-five percent (35%) of said interior volume.

5. A ball-like article according to claim 1 and characterized further in that said outer skin is fabricated of a two-ply sheet material having a fabric substrate and a resilient polymeric plastic layer bonded thereto.

6. A ball-like article according to claim 1 and characterized further in that said granular material comprises a quantity of pellets of a relatively low density, non-resilient plastic material having a relatively low coefficient of friction.

7. A ball-like article according to claim 6 and characterized further in that said plastic material is polypropylene, polyethylene or polystyrene.

8. A ball-like article according to claim 6 and characterized further in that said pellets have a generally rounded exterior shape.

9. A ball-like article according to claim 1 and characterized further in that the largest cross-sectional dimension of said outer skin is in the range of approximately three inches to six inches.

10. A ball-like article according to claim 9 and characterized further in that said outer skin is generally spheroidal in shape.

11. A ball-like article according to claim 9 and characterized further in that said outer skin is generally ellipsoidal in shape.

12. A ball-like article according to claim 9 and characterized further in that said ball-like article is of a total weight in the range of approximately four ounces to five ounces.

13. A ball-like article according to claim 1 and characterized further in that said ball-like article is of a total weight in the range of approximately four ounces to five ounces.

14. A ball-like article according to claim 1 and characterized further in that said outer skin is generally ellipsoidal in shape, said tail being attached to one end of said outer skin.

15. A ball-like article according to claim 1 and characterized further in that said tail portion comprises a pair of tail segments attached to said outer skin at a common location.

16. A ball-like article according to claim 1 and characterized further in that said tail portion is of a length extending approximately twenty (20) to twenty-four (24) inches outwardly from said outer skin.

17. A ball-like article according to claim 1 and characterized further in that said tail portion is formed of a generally non-stretchable material.

18. A ball-like article comprising a main body of a rounded three-dimensional configuration and size adapted to be readily grasped by a hand, and a tail portion attached to said main body for grasping and tossing said article, said ball-like article being of a total weight in the range of approximately four ounces to five ounces.

19. A ball-like article according to claim 18 and characterized further in that the largest cross-sectional dimension of said main body is in the range of approximately three (3) inches to six (6) inches.

20. A ball-like article according to claim 18 and characterized further in that said main body is generally ellipsoidal in shape, said tail being attached to one end of said main body.

21. A ball-like article according to claim 20 and characterized further in that said tail portion comprises a pair of tail segments attached to said main body at a common location.

22. A ball-like article according to claim 18 and characterized further in that said tail portion is of a length extending approximately twenty (20) to twenty-four (24) inches outwardly from said main body.

23. A ball-like article according to claim 18 and characterized further in that said tail portion is formed of a generally non-stretchable material.

* * * * *